US007698990B2

(12) United States Patent
Paulmann

(10) Patent No.: US 7,698,990 B2
(45) Date of Patent: Apr. 20, 2010

(54) HYDRAULIC LINEAR ACTUATING DRIVE

(75) Inventor: Gregor Paulmann, Grasbrunn-Neukeferloh (DE)

(73) Assignee: Eurocopter Deutschland GmbH, Donauworth (DE)

( * ) Notice: Subject to any disclaimer, the term of this patent is extended or adjusted under 35 U.S.C. 154(b) by 139 days.

(21) Appl. No.: 11/611,953

(22) Filed: Dec. 18, 2006

(65) Prior Publication Data

US 2007/0144342 A1 Jun. 28, 2007

(30) Foreign Application Priority Data

Dec. 23, 2005 (DE) ..... 10 2005 062 346

(51) Int. Cl.
*F01B 31/00* (2006.01)

(52) U.S. Cl. ..... 92/86

(58) Field of Classification Search ..... 92/86
See application file for complete search history.

(56) References Cited

U.S. PATENT DOCUMENTS 2,295,160 A * 9/1942 Christenson ..... 92/244
3,168,013 A * 2/1965 Williamson ..... 92/174
5,036,933 A * 8/1991 Heinrich ..... 92/86
5,265,423 A * 11/1993 Glaser ..... 92/86
5,582,009 A * 12/1996 Brieschke ..... 92/86

* cited by examiner

*Primary Examiner*—Michael Leslie
(74) *Attorney, Agent, or Firm*—Darby & Darby

(57) ABSTRACT

A hydraulic linear actuating drive includes a cylinder, a movable servo piston that can be pressure-loaded and that runs inside the cylinder, at least one piston rod attached to the servo piston, and at least one piston gasket having at least two sealing elements at a distance from each other. An intermediate sealing space is defined between the at least two sealing elements, an inner wall of the cylinder and an outer edge of the servo piston. The hydraulic linear actuating drive has at least one leakage channel that can move together with the servo piston. A first end of the channel opens into the intermediate sealing space and into a leakage fluid inlet opening located there, while the other, second end of the channel opens into a leakage fluid outlet opening arranged outside of the cylinder.

6 Claims, 1 Drawing Sheet

HYDRAULIC LINEAR ACTUATING DRIVE

Priority is claimed to German Patent Application No. DE 10 2005 062 346.8, filed on Dec. 23, 2005, the entire disclosure of which is incorporated by reference herein.

The present invention relates to a hydraulic linear actuating drive.

DESCRIPTION OF RELATED ART

Hydraulic linear actuating drives are equipped with a movable servo piston that can be pressure-loaded and that runs inside a cylinder, as well as with a piston rod attached to the servo piston. The servo piston is fitted with at least one piston gasket that lies against the inner wall of the cylinder. During operation of the actuating drive, the servo piston is moved linearly inside the cylinder by means of a hydraulic fluid that is under high pressure, as a result of which the servo piston can transfer an actuating force via the piston rod to an actuating element connected thereto. Owing to wear and tear or failure of the piston gasket, leakage can occur internally, that is to say, inside the cylinder, from the piston gasket. According to the methods known so far, these internal leaks from the piston gasket can only:

a) be ascertained or checked by means of a direct test of the actuating drive force or of the hydraulic pressure, or else
b) by measuring the internal leakage by monitoring the throughput volume.

For this purpose, in both cases, the actuating drive has to be removed from an existing hydraulic system (for example, the hydraulic system of an aircraft) and a test bench has to be employed that has a hydraulic pressure supply and appropriate pressure sensors or flow sensors. Moreover, it is also absolutely indispensable to open up the hydraulic system or even the actuating drive that has been removed. This gives rise to additional dismantling and assembly work as well as follow-up work. The above-mentioned measures are specified in aircraft engineering by the so-called overhaul times (also called "time between overhauls").

Piston leakage due to failure of the piston gasket causes a loss of the hydraulic power boost and of the actuating precision of the actuating drive in question. Particularly with the redundant systems that are commonly employed in aircraft engineering such as, for instance, hydraulic linear actuating drives in an active/inactive tandem arrangement, as well as in the case of a complex installation situation, such a failure cannot always be detected immediately. This degrades the redundancy of the affected hydraulic system, which is a safety-critical issue. This degradation is also referred to as a dormant error.

Consequently, during the qualification of piston gaskets, especially for hydraulic systems used in aircraft engineering, protracted wear-and-tear tests are needed which, however, as a rule, cannot simulate or replicate the entire duration of use of the actuating drive. This is why the above-mentioned overhaul times are specified, that is to say, the safe functioning of the actuating drive is checked at precisely defined intervals.

It is obvious that these inspections entail considerable labor and costs. In such examinations, it is often found that the piston gasket is still intact, so that the removal of the actuating drive from the hydraulic system was, in fact, unnecessary.

SUMMARY OF THE INVENTION

An object of the present invention is to provide a hydraulic linear actuating drive with which internal leakage from the piston gasket can be detected reliably and simply.

This hydraulic linear actuating drive is equipped with a cylinder, with a movable servo piston that can be pressure-loaded and that runs inside the cylinder, with at least one piston rod attached to the servo piston as well as with at least one piston gasket having at least two sealing elements at a distance from each other which, between them, an inner wall of the cylinder and an outer edge of the servo piston, define an intermediate sealing space. The hydraulic linear actuating drive has at least one leakage channel that can move together with the servo piston, and a first end of said channel opens into the intermediate sealing space and into a leakage fluid inlet opening located there, while the other, second end of said channel opens into a leakage fluid outlet opening arranged outside of the cylinder.

In the case of leakage from the piston gasket in the actuating drive according to the invention, an impermissible flow of leaking oil occurs (note: here, the term oil flow refers to the flow of hydraulic fluid with which the servo piston is pressure-loaded) beyond at least one sealing element and into the intermediate sealing space as well as into the leakage fluid inlet opening. The quantity of this flow of leaking oil differs substantially from the regular minimal leakages from an intact piston gasket. Due to the pronounced pressure gradient in the case of overflows from the (appertaining) operating chamber of the cylinder, the flow of leaking oil passes through the leakage fluid inlet opening and penetrates into the leakage channel, subsequently leaking out again via the leakage fluid outlet opening arranged outside of the cylinder. The flow of leaking oil can immediately be detected there.

Consequently, with the actuating drive according to the invention, leakage from the piston gasket can be reliably detected by a visual inspection without the need for removing the actuating drive from the entire hydraulic system or checking it in the manner described above according to variant a) or b). Therefore, the use of a complex and expensive test bench can be dispensed with. On the contrary, the actuating drive according to the invention can even be checked in the installed state. For instance, with hydraulic systems used in aircraft, leakage from the piston gasket can already be checked within the scope of the so-called pre-flight inspection or post-flight inspection. Monitoring within the framework of regularly scheduled inspections (also referred to as "on condition monitoring) is likewise feasible. Consequently, constant monitoring is possible over the entire time during which the actuating drive is in use. In this manner, the solution according to the invention also prevents dormant errors, thus being instrumental for the safety of the hydraulic system or of the device or aircraft in which the actuating drive according to the invention is installed.

The principle of the solution according to the invention is also possible for so-called double-acting hydraulic cylinders or for cylinders that have a piston rod on both sides of the servo piston.

Other preferred and advantageous embodiment features of the hydraulic linear actuating drive according to the invention are the subject matter of the claims.

BRIEF DESCRIPTION OF THE DRAWINGS

Preferred embodiments of the invention with additional configuration details and further advantages will be described in greater detail and explained below making reference to the accompanying drawings, which show the following.

PRESENTATION OF PREFERRED EMBODIMENTS

Figure 1:
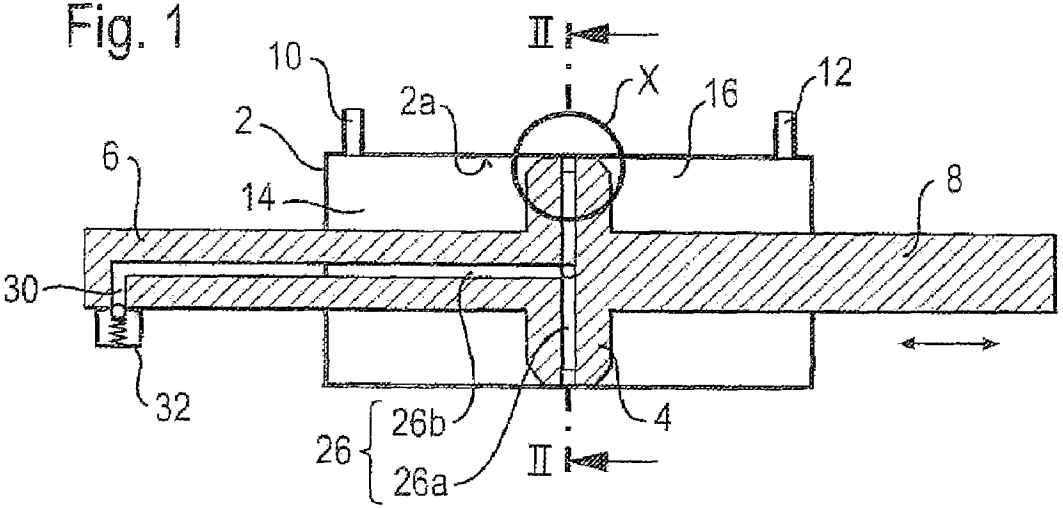
FIG. 1—a schematic longitudinal section through a hydraulic linear actuating drive according to the invention.
Figure 2:
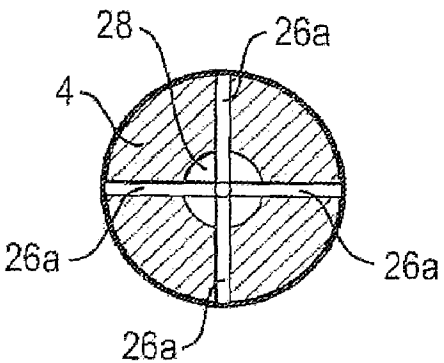
FIG. 2—a sectional view of the actuating drive according to the invention as shown in FIG. 1 along line II-II in FIG. 1.

FIG. 1 shows a schematic longitudinal section through a hydraulic linear actuating drive according to the invention. FIG. 2 depicts a sectional view of the actuating drive according to the invention as shown in FIG. 1 along line II-II in FIG. 1.

The actuating drive has a cylinder 2, a movable servo piston 4 that can be pressure-loaded and that runs inside the cylinder 2, two piston rods 6, 8 that are attached to the top and bottom of the servo piston 4 and that protrude from opposing ends of the cylinder 2. This is a so-called double-acting drive, that is to say, each side of the servo piston can be hydraulically pressure-loaded whenever needed. The hydraulic working fluid, so-called hydraulic oil, is fed in via openings 10, 12 into the appertaining left-hand and/or right-hand operating chamber 14, 16 of the cylinder 2.

The actuating drive also has a piston gasket comprising two sealing elements 18, 20 at a distance from each other. These two sealing elements are sealing rings that are each accommodated in a groove provided in the outer circumference of the servo piston 4. Between them, an inner wall 42 of the cylinder 2 and the outer circumference or outer edge of the servo piston 4, these sealing rings 18, 20 delimit an intermediate sealing space 22.

Figure 4:
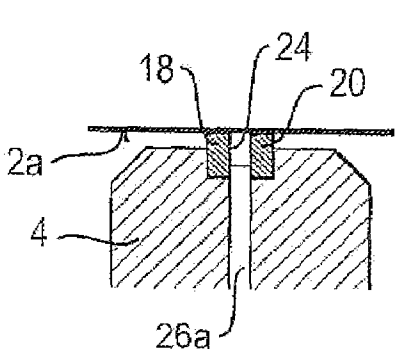
FIG. 4—a second detail of the actuating drive according to the invention in the area X indicated in FIG. 1.
Figure 3:
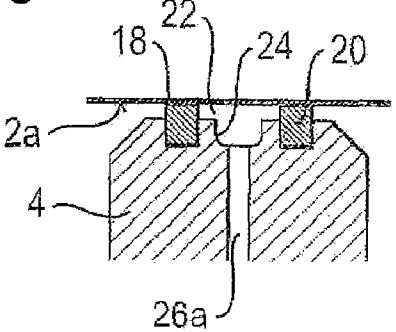
FIG. 3—a first detail of the actuating drive according to the invention in the area X indicated in FIG. 1.

FIG. 3 shows a first detail of the actuating drive according to the invention in the area X indicated in FIG. 1, while FIG. 4 shows a second detail of the actuating drive according to the invention in the area X indicated in FIG. 1. In the variant according to FIG. 3 as well as in the variant according to FIG. 4, a circumferential leakage groove 24 is provided on the outer circumference of the servo piston 4 in the intermediate sealing space 22 between the two sealing rings 18, 20 that are at a distance from each other. In the embodiment according to FIG. 3, part of the outer wall of the servo piston 4 forms the side wall of the leakage groove 24, while in the embodiment according to FIG. 3, the side walls of the leakage groove 24 are delimited by a partial lateral area of the sealing rings 18, 20 themselves.

The actuating drive according to the invention is also fitted with a leakage channel 26 that can move together with the servo piston. The first end of this leakage channel 26 opens into the intermediate sealing space 22 and into a leakage fluid inlet opening located there, which, in turn, opens into the leakage groove 24. This applies to the detail variants according to FIG. 3 as well as according to FIG. 4. The other, second end of this leakage channel 26 opens into a leakage fluid outlet opening arranged outside of the cylinder 2. The leakage channel 26 has a first channel section that extends in the radial direction from the leakage fluid inlet opening through the servo piston 4 to its center area.

As can be seen in FIG. 2, which shows a sectional view of the actuating drive according to the invention as shown in FIG. 1 along line II-II in FIG. 1, the first channel section is formed in the servo piston 4 by four radial bores 26*a* that are distributed uniformly along the circumference of the servo piston 4 and that open into a central chamber 28 of the servo piston 4. The number of radial bores can vary, depending on the application in question.

Moreover, the leakage channel 26 has a second channel section 26*b* that opens into the central chamber 28 and thus into the first channel section 26*a*. Starting from the central chamber 28, the second channel section 26*b* runs through the piston rod 6, as shown on the left-hand side of FIG. 1, all the way to a leakage fluid outlet opening provided on the piston rod 6 along the entire maximum actuating distance of the servo piston 4 outside of the cylinder 2. The second channel section 26*b* extends coaxially through the piston rod 6.

Near the end of the piston rod 6, as shown on the left-hand side in FIG. 1, starting from the outer circumference of the piston rod 6, a radial test bore 30 is created that opens into the second channel section 26*b*. The opening of the test bore 30 here forms the leakage fluid outlet opening. A valve 32 that opens towards the outside of the leakage channel 26 and that closes towards the inside of the leakage channel 26 is provided, in turn, on the leakage fluid outlet opening. The valve 32 in this example is configured as a rubber membrane that concurrently prevents dirt from getting into the leakage channel.

With the above-mentioned actuating drive according to the invention shown in the figures, leakage from the first sealing ring 18 as well as from the second sealing ring 20 can be reliably detected.

The invention is not restricted to the embodiment above. Within the protective scope, the actuating drive according to the invention can also take on configurations that differ from the one concretely described above. As an alternative or in addition, the second channel section 26*b* could be provided in the second piston rod 8 as well. Moreover, the second channel section 26*b* could have an opening at the front end of the piston rod 6, 50 that the second channel section 26*b* can easily be made by drilling. Since connection fittings are usually attached to the front end of the piston rods 6, 8, such a position for the leakage fluid outlet opening would, however, be very unsuitable for visual inspections. Therefore, after the second channel section 26 has been drilled, the bore opening could be closed again so that the configuration shown in FIG. 1 could be restored, for example, by means of the test bore 30.

The leakage channel could also run in certain areas through a tube-like element that can continuously follow the movements of the servo piston without any collision. This tube-like element or the leakage fluid outlet opening could then even pass through the wall of the cylinder as well, and a second channel section in the piston rod or rods could be totally dispensed with.

What is claimed is:

1. A hydraulic linear actuating drive for an aircraft arrangement comprising:

a cylinder with a first end and a second end, the first and the second ends opposing one another;

a movable servo piston capable of being pressure-loaded and running inside the cylinder, wherein the movable servo piston separates two operating chambers;

a hydraulic working fluid occupying both of the two operating chambers;

a first and a second piston rod attached to the servo piston, wherein the first piston rod protrudes from the first end, and wherein the second piston rod protrudes from the second end, and wherein the first piston rod is attached to an actuating element;

at least one piston gasket having at least two sealing elements disposed at a distance from each other, an intermediate space being defined between the at least two sealing elements, an inner wall of the cylinder and an outer edge of the servo piston;

at least one leakage channel moveable together with the servo piston and having a first end opening into a leakage fluid inlet opening located in the intermediate sealing space and a second end opening into a leakage fluid outlet opening arranged outside of the cylinder; and a valve disposed outside of the cylinder on the leakage fluid outlet opening, the valve opening towards an outside of the leakage channel and closing towards an inside of the leakage channel.

2. The hydraulic linear actuating drive as recited in claim 1, wherein the leakage channel has a first channel section extending in a radial direction from the leakage fluid inlet opening through the servo piston to a center area of the servo piston.

3. The hydraulic linear actuating drive as recited in claim 2, wherein the leakage channel has a second channel section opening into the at least one first channel section and running through the at least one piston rod to the leakage fluid outlet opening along an entire maximum actuating distance of the servo piston outside of the cylinder.

4. The hydraulic linear actuating drive as recited in claim 3, wherein the second channel section extends coaxially with the at least one piston rod.

5. The hydraulic linear actuating drive as recited in claim 3, wherein the leakage fluid outlet opening is formed by at least one radial test bore starting from an outer circumference of the piston rod and opening into the second channel section.

6. The hydraulic linear actuating drive as recited in claim 1, further comprising a leakage groove disposed on an outer circumference of the servo piston in the intermediate sealing space, and wherein the leakage fluid inlet opening opens into the leakage groove.

* * * * *